US009111516B1

(12) United States Patent
Saraceni

(10) Patent No.: US 9,111,516 B1
(45) Date of Patent: Aug. 18, 2015

(54) PORTABLE FLOOR PIANO WITH FOLDING KEYBOARD

(71) Applicant: Remo Saraceni, Philadelphia, PA (US)

(72) Inventor: Remo Saraceni, Philadelphia, PA (US)

( * ) Notice: Subject to any disclaimer, the term of this patent is extended or adjusted under 35 U.S.C. 154(b) by 0 days.

(21) Appl. No.: 14/298,926

(22) Filed: Jun. 8, 2014

(51) Int. Cl.
*G10H 1/18* (2006.01)
*G10H 1/34* (2006.01)

(52) U.S. Cl.
CPC . *G10H 1/18* (2013.01); *G10H 1/34* (2013.01); *G10H 2220/341* (2013.01)

(58) Field of Classification Search
USPC ..... 84/721, 746
IPC ..... G10H 1/18,1/34
See application file for complete search history.

(56) References Cited

U.S. PATENT DOCUMENTS 2,102,086 A * 12/1937 Mueller ..... 160/229.1
3,091,454 A * 5/1963 Sam ..... 473/414
3,546,995 A * 12/1970 Semprevivo ..... 84/444
3,585,893 A * 6/1971 Arseneault ..... 84/721
3,626,350 A * 12/1971 Suzuki et al. ..... 338/69
3,913,443 A * 10/1975 Jewett ..... 84/642
3,922,944 A * 12/1975 Kurosaki et al. ..... 84/721
3,956,958 A * 5/1976 Nash et al. ..... 84/687
3,962,945 A * 6/1976 Creager et al. ..... 84/715
4,121,488 A * 10/1978 Akiyama ..... 84/720
4,245,539 A * 1/1981 Jones ..... 84/672
4,491,050 A * 1/1985 Franzmann ..... 84/746
4,706,536 A * 11/1987 Sanders ..... 84/719
4,810,992 A * 3/1989 Eventoff ..... 338/99
4,924,743 A * 5/1990 Tsai ..... 84/476
5,008,497 A * 4/1991 Asher ..... 178/18.05
5,033,241 A * 7/1991 Max ..... 52/71
5,079,536 A * 1/1992 Chapman ..... 338/99
5,166,467 A * 11/1992 Brown ..... 84/715
5,398,585 A * 3/1995 Starr ..... 84/646
5,616,897 A * 4/1997 Weber et al. ..... 200/5 A
5,726,374 A * 3/1998 Vandervoort ..... 84/638
5,803,835 A * 9/1998 Moton et al. ..... 473/414
5,837,952 A * 11/1998 Oshiro et al. ..... 200/86 R
6,259,006 B1 * 7/2001 Parienti ..... 84/171
6,329,620 B1 * 12/2001 Oishi et al. ..... 200/86.5
6,700,051 B2 * 3/2004 Aldridge ..... 84/733
D490,837 S * 6/2004 Chang ..... D17/1
6,743,971 B1 * 6/2004 Chen ..... 84/746
6,758,753 B1 * 7/2004 Nagata et al. ..... 463/36
6,875,913 B2 * 4/2005 Bubar ..... 84/423 R
7,060,000 B2 * 6/2006 Carlson ..... 482/1
7,247,788 B2 * 7/2007 Lai ..... 84/719

(Continued)

OTHER PUBLICATIONS

YouTube video of big floor piano. https://www.youtube.com/watch?v=cxfOTZDINkc Uploaded to YouTube on Nov. 14, 2011.*

*Primary Examiner* — David Warren
(74) *Attorney, Agent, or Firm* — LaMorte & Associates, P.C.

(57) ABSTRACT

An electronic interactive instrument that is played by the feet of a person who walks upon the instrument. The instrument has a flexible cover plate upon which a person can walk. The cover plate contains an image of a keyboard with both imaged white keys and imaged black keys. A plurality of support beams are provided under the cover plate. At least one of the support beams is disposed under each of the imaged white keys and the imaged black keys. A plurality of pressure sensors are affixed to the support beams. The pressure sensors can detect when the cover plate is flexed by the weight of person. As such, the pressure sensors can detect where a person is standing on the cover plate.

14 Claims, 6 Drawing Sheets

(56) References Cited

U.S. PATENT DOCUMENTS

| | | | | |
|---|---|---|---|---|
| 7,361,856 | B1 * | 4/2008 | Anderson | 200/85 R |
| 7,465,868 | B2 * | 12/2008 | Lengeling | 84/719 |
| 7,646,374 | B2 * | 1/2010 | Dickson | 345/168 |
| 7,938,751 | B2 * | 5/2011 | Nicolas et al. | 482/1 |
| 7,977,561 | B2 * | 7/2011 | Folkesson | 84/615 |
| 8,079,251 | B2 * | 12/2011 | Miyanaga | 73/65.01 |
| 8,217,922 | B2 * | 7/2012 | Wainwright | 345/204 |
| 8,246,521 | B2 * | 8/2012 | Alexander et al. | 482/8 |
| 8,674,207 | B1 * | 3/2014 | Seymour | 84/615 |
| D706,230 | S * | 6/2014 | McMillen | D13/164 |
| 2003/0015087 | A1 * | 1/2003 | Haken | 84/658 |
| 2005/0034591 | A1 * | 2/2005 | Chang | 84/730 |
| 2006/0123982 | A1 * | 6/2006 | Christensen | 84/723 |
| 2006/0258512 | A1 * | 11/2006 | Nicolas et al. | 482/52 |
| 2007/0000374 | A1 * | 1/2007 | Clark et al. | 84/724 |
| 2008/0200285 | A1 * | 8/2008 | Haseth | 473/422 |
| 2009/0266218 | A1 * | 10/2009 | Parienti | 84/171 |
| 2012/0144981 | A1 * | 6/2012 | Ciccone | 84/746 |
| 2013/0181907 | A1 * | 7/2013 | Russell et al. | 345/172 |
| 2014/0220318 | A1 * | 8/2014 | Pervan | 428/206 |

* cited by examiner

PORTABLE FLOOR PIANO WITH FOLDING KEYBOARD

BACKGROUND OF THE INVENTION

1. Field of the Invention

In general, the present invention relates to electronic keyboards, such as piano keyboards. More particularly, the present invention relates to large keyboards that are played by walking or dancing upon the surface of the keyboard.

2. Prior Art Description

In the 1998 movie "BIG", the iconic moment that many people remember is when the star of the movie, Tom Hanks, plays upon a large floor piano. That floor piano was designed and built by Remo Saraceni in 1982, the inventor herein. Since the release of the movie "BIG", Mr. Saraceni has been commissioned to build a variety of floor pianos for children's museums, children's hospitals, stores and institutions around the world. However, building a floor piano is far more complex than building just a large touchpad keyboard.

Early versions of floor pianos were devices that were set upon a floor. People only stepped on the floor piano when they intended to play the floor piano. This was problematic because the floor piano was large and required a large amount of floor space. The floor piano was too large to store away easily. As such, it was often just left in place and often became an obstacle to walking traffic.

Seeing the inconveniences of leaving a large floor piano on the floor, customers began to request floor pianos that were more portable, yet provided the same quality as a traditional Saraceni Big piano.

Due in no small part to the movie "Big", several toy piano mats were marketed. These toy pianos mats where electronic touchpads that were decorated in the form of a piano. These touchpad mats were relatively small and could be folded or rolled up for storage. The touchpad mats contained sensors that were coupled to a sound generator. As such, when a person pressed on different points of the mat, different notes would sound.

Such toy touchpad mats may be fun in a child's bedroom, but they cannot be effectively used in a commercial space or public venue, such as a museum or toy store. Touchpad mats are small and slide on most floor surfaces. Furthermore, toy touchpad mats are too light to lay flat. As such, they must be taped down so as not to present a tripping hazard. Lastly, toy touchpad mats are made from thin sheets of plastic. Toy touchpad mats would quickly tear and there decorations wear away, if they were mounted in areas frequented by the public.

The present inventor has developed an improved floor piano that is portable, yet is designed to be placed on a floor indefinitely. The floor piano is designed to be tread upon by hundreds of people, while resisting wear. This improved floor piano keyboard is described and claimed below.

SUMMARY OF THE INVENTION

The present invention is an electronic interactive instrument that is played by the feet of a person who walks upon the instrument. The instrument has a cover plate with precisely controlled flexibility upon which a person can walk. The cover plate contains an image of a keyboard with both imaged white keys and imaged black keys.

A plurality of support beams are provided under the cover plate. The support beams are arranged in parallel and support the cover plate in a horizontal plane. At least one of the support beams is disposed under each of the imaged white keys and the imaged black keys.

A plurality of pressure sensors are provided. The pressure sensors are affixed to the support beams, wherein the pressure sensors are interposed between the support beams and the cover plate. The pressure sensors can detect when the cover plate is flexed by the weight of person. As such, the pressure sensors can detect where a person is standing on the cover plate. A plurality of controllable lights is provided, one at each white key and each black key location. Key lights can be controlled in terms of color and intensity, and can be illuminated independently and individually in order to provide cues to the person playing the instrument.

An electronic sound generator is provided. The sound generator is triggered by the pressure sensors. The sound generator can generate a different note or audio effect for each of the imaged white keys and each of the imaged black keys. Accordingly, different notes can be sounded when a person steps upon the various imaged white keys and imaged black keys.

The electronic interactive instrument contains a microprocessor that monitors the sensors and controls the sound generation and key lights. The microprocessor also provides access to a library pf musical pieces and learning programs.

The electronic interactive instrument is configured as a one-octave keyboard. Multiple keyboards can be interconnected to create larger instruments. Supplemental keyboards are also programmable and can be set to have the same characteristics or different characteristics as the original keyboard. This modularity enables the electronic interactive instrument to be tailored to the physical space and budget of a specific consumer.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention assembly can be embodied in many ways, only one exemplary embodiment is illustrated and described. The exemplary embodiment only contains two octaves and is not a full eighty-eight octave piano keyboard. The illustrated embodiment, however, is merely exemplary and should not be considered a limitation when interpreting the scope of the appended claims. The present invention assembly can be created to contain any number of octaves.

Figure 1:
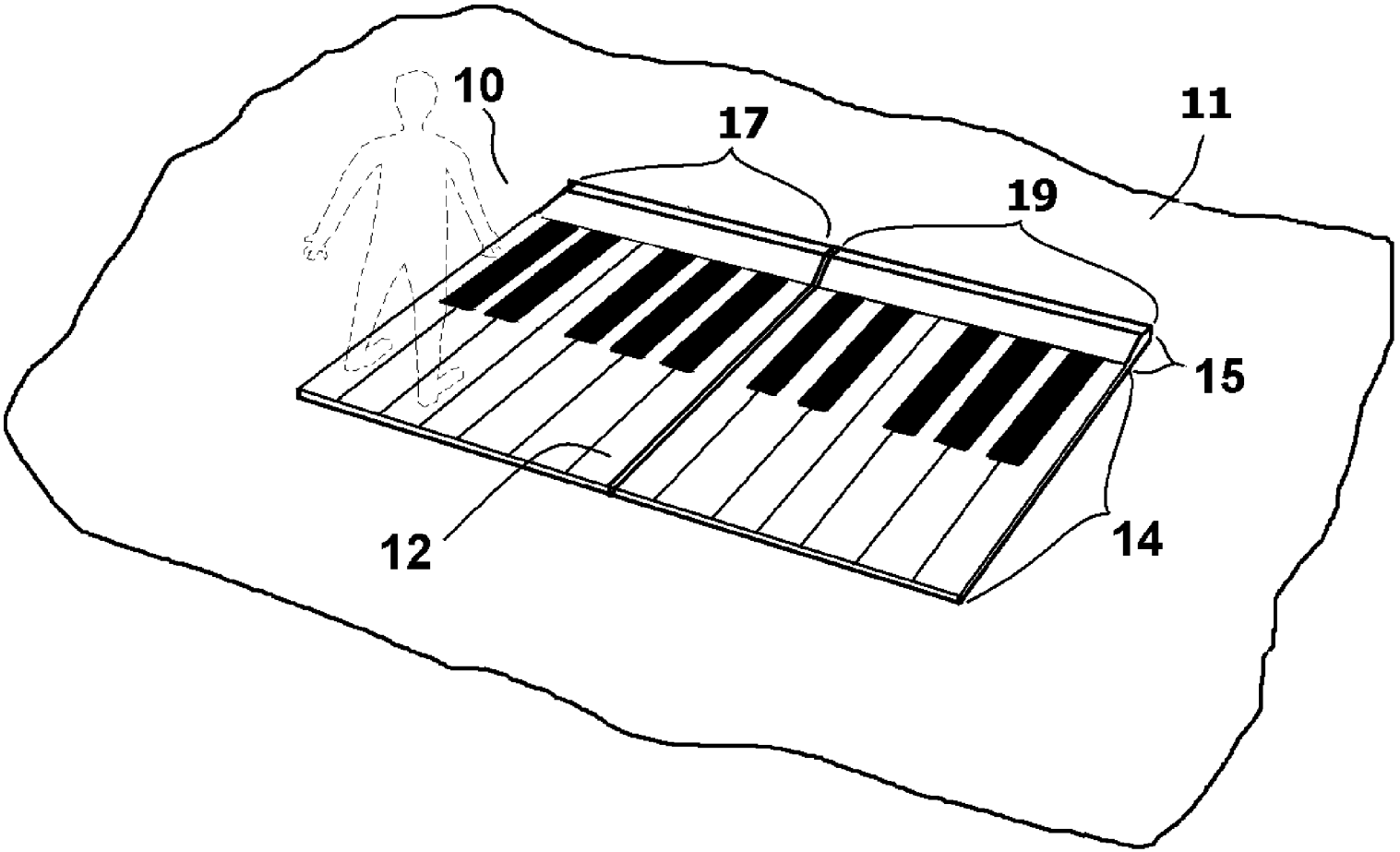
FIG. 1 is a perspective view of an exemplary embodiment of the present invention floor instrument.
Figure 2:
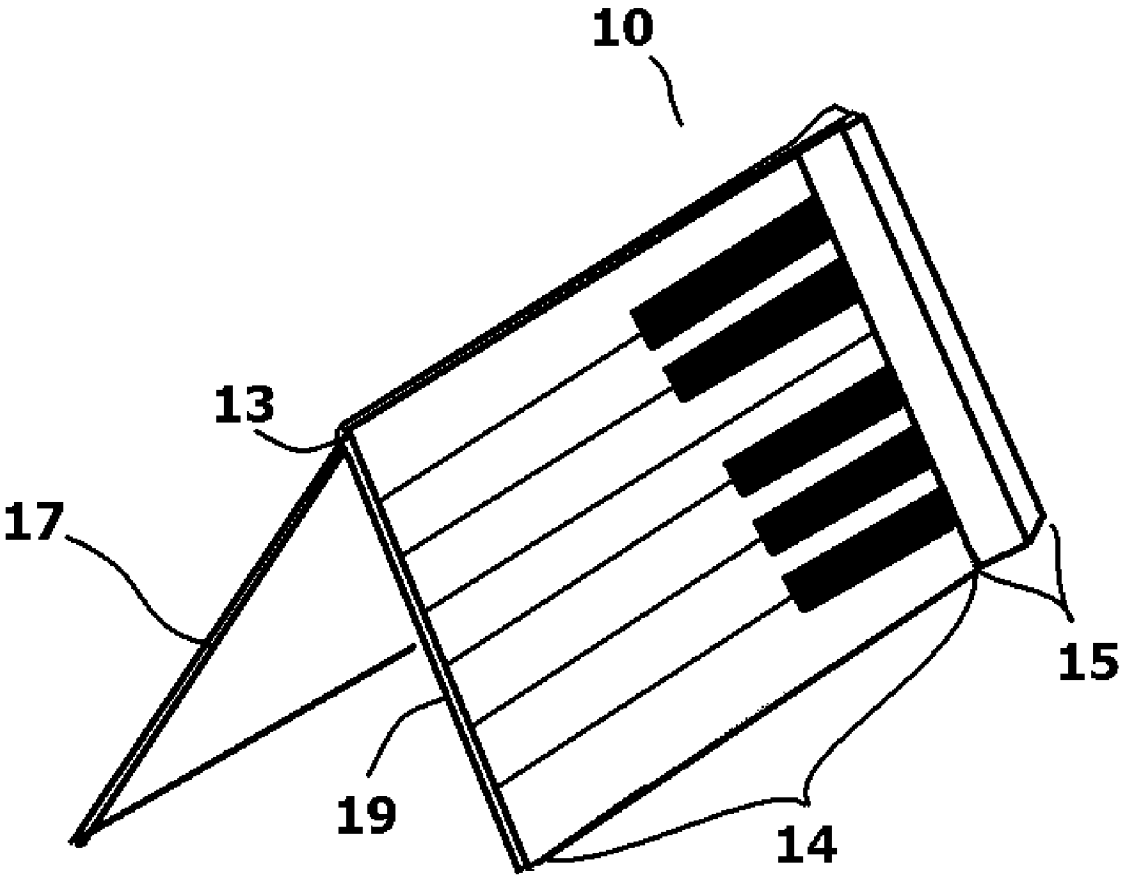
FIG. 2 shows the floor instrument of FIG. 1 in a partially folded condition.
Figure 3:
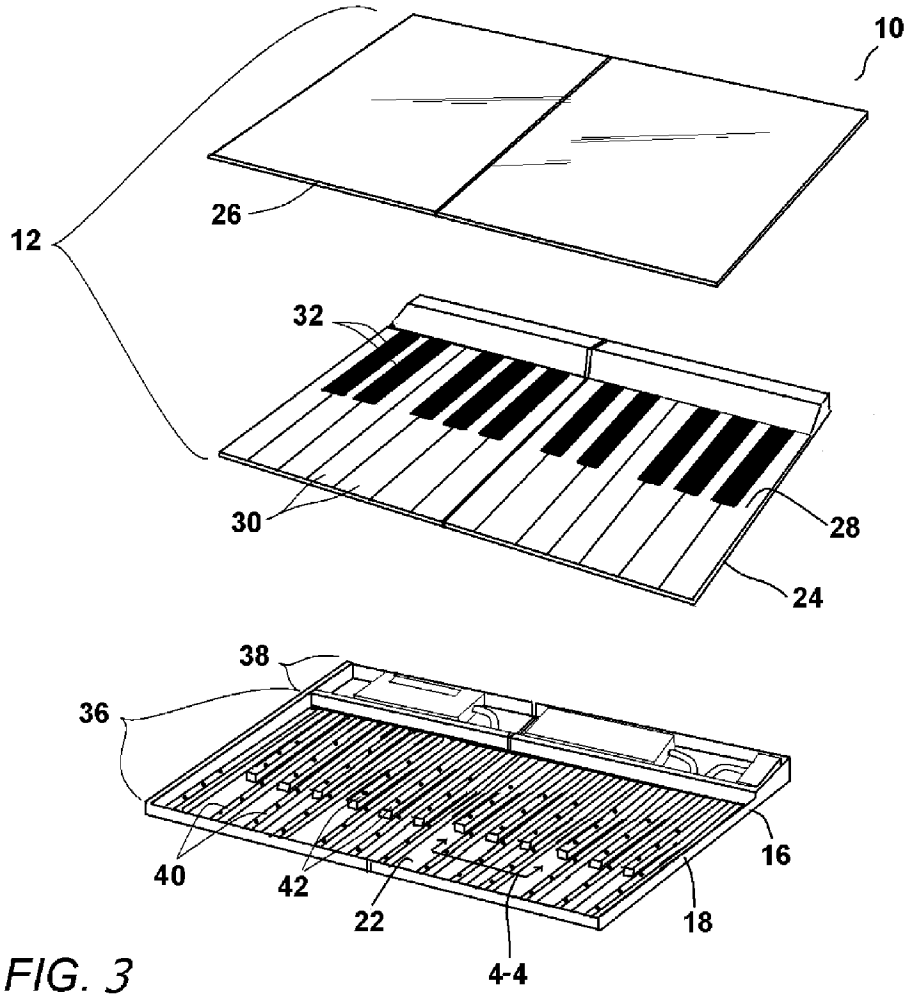
FIG. 3 is an exploded view of the exemplary embodiment of FIG. 1.

Referring to FIG. 1, FIG. 2 and FIG. 3 in combination, the floor instrument 10 is shown. The floor instrument 10, when laying flat upon the floor 11, contains an active keyboard section 14 and an inactive boarder section 15. The keyboard section 14 has the appearance of keys on a keyboard. The keyboard section 14 is thin so it can be easily stepped upon by a person walking along the floor 11. The boarder section 15 is slightly thicker so as to accommodate many of the electronic controls required to operate the floor instrument 10, as will later be explained.

The floor instrument 10 can be folded in half. Both the keyboard section 14 and the boarder section 15 are bisected by a hinge connection 13. The hinge connection 13 divides the keyboard section 14 and the boarder section 15 into two halves 17, 19. When the floor instrument 10 is folded for storage, the two halves 17, 19 abut in parallel planes. When the floor instrument 10 is opened for use, the two halves 17, 19 are coplanar.

Each half of the keyboard section 14 is covered by a layered cover plate 12. When the floor instrument 10 is unfolded, each layered cover plate 12 lays parallel to the floor 11 of the building. Each layered cover plate 12 is flat and contains no raised elements or moving elements that can cause a tripping hazard. As will be later explained, each layered cover plate 12 only flexes slightly when a person walks upon that layered cover plate 12.

Each half 17, 19 of the floor instrument 10 has a housing 16 that supports the layered cover plate 12. The housing 16 has side surfaces 18 and a bottom surface 20 that combine with the layered cover plate 12 to define an isolated interior 22. The side surfaces 18 of the housing 16 preferably have a height of no more than three inches in order to provide the floor instrument 10 with a very narrow physical profile.

Each layered cover plate 12 of the floor instrument 10 has a double layered construction that includes a decorative layer 24 and a protective layer 26. The protective layer 26 is the top layer. The protective layer 26 is a clear layer of a high strength acrylic polymer that is preferably between ¼ inch and ½ inch thick. The decorative layer 24 is disposed directly underneath the protective layer 26 and is the same size as the protective layer 26. The decorative layer 24 is a layer of a clear high strength polymer that is painted or printed with a large keyboard image 28. The decorative layer 24 has a thickness that is preferably between ⅛ inch and ¼ inch. The keyboard image 28 includes imaged white keys 30, and shorter imaged black keys 32 that run in a traditional piano pattern. The imaged white keys 30 and imaged black keys 32 are painted/printed to be somewhat translucent for a reason that is later explained.

Since each layered cover plate 12 is comprised of two layers of high strength plastic, that in combination can be up to ¾ of an inch thick, it will be understood that each layered cover plate 12 has significant strength. When supported in the manner later explained, each layered cover plate 12 can easily support the weight of 100 pounds per square foot. This meets or exceeds the building code requirements of flooring in public buildings.

The isolated interior 22 of each housing 16 is divided into two areas. Those areas include a key support area 36 and the electronic support area 38. The key support area 36 lay under the active keyboard section 14 of the layered cover plate 12. Thus, the key support area 36 lay under the keyboard image 28. The electronic support area 38 lay under the inactive boarder section 15.

Figure 4:
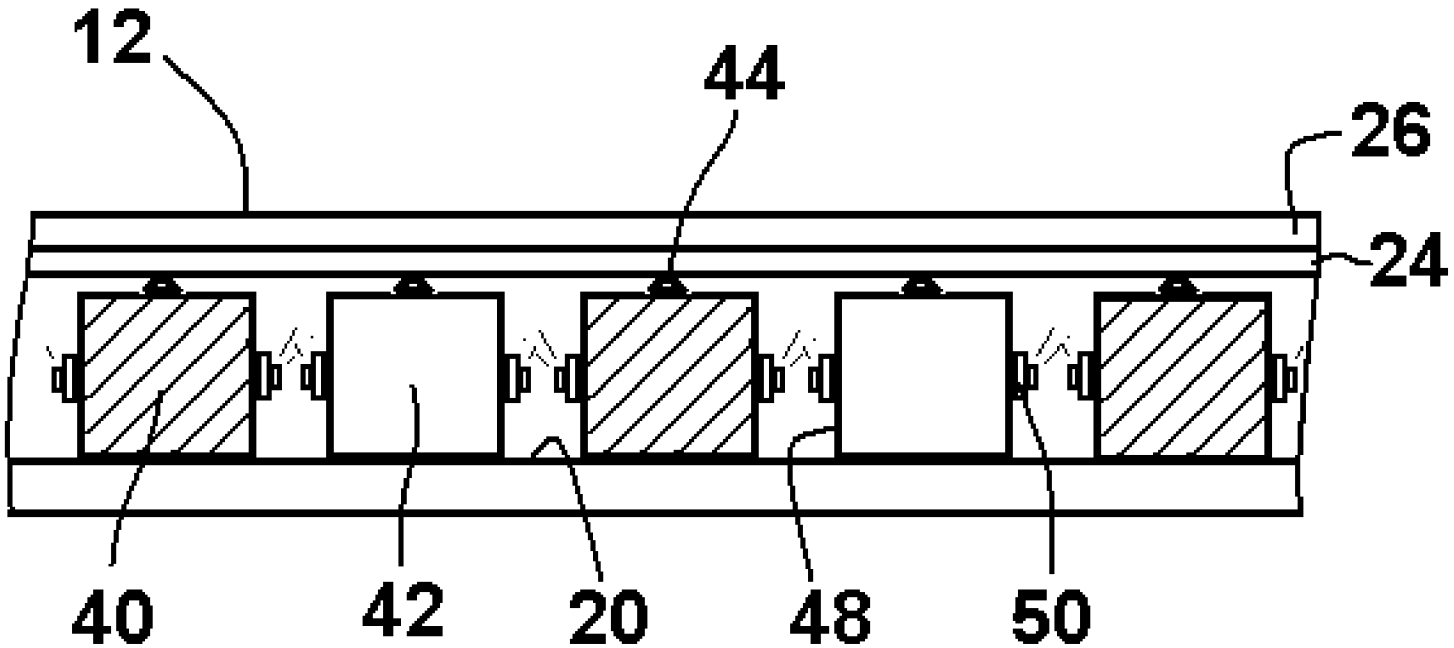
FIG. 4 is a cross-sectional view of the exemplary embodiment of FIG. 1, viewed along section line 4-4.

Referring to FIG. 4 in conjunction with FIG. 3, it can be seen that within the key support area 36 are provided a plurality of beam supports 40, 42. Each beam support is a square or rectangular tube of metal. The beam supports include long beam supports 40 and short beam supports 42. A long beam support 40 is positioned within the interior 22 of the housing 16 to correspond to the center of each of the imaged white keys 30 printed on the decorative layer 24 of the cover plate 12. Likewise, a short beam support 42 is positioned to correspond to the center of each of the imaged black keys 32 printed on the decorative layer 24 of the cover plate 12. As such, it will be understood that under each imaged white key 30 and each imaged black key 32, the cover plate 12 is supported by a metal beam. Depending upon the size of the floor instrument 10, the space between adjacent long beam supports 40 is between 10 inches and 18 inches. The space between adjacent long beam supports 40 and short beam supports 42 is half that distance. Consequently, each layered cover plate 12 is firmly supported. This enables each layered cover plate 12 to bear large weights while still maintaining a significant degree of flexibility.

A series of pressure sensors 44 are affixed to each of the long beam supports 40 and the short beam supports 42. The pressure sensors 44 are interposed between the beam supports 40, 42 and the layered cover plate 12. When a person steps onto the layered cover plate 12, it will be understood that the layered cover plate 12 will slightly flex in the area where weight is applied. The degree of flex is limited by the presence of the many long beam supports 40 and short beam supports 42 under the cover plate 12. However, the pressure sensors 44 are calibrated to the weight of the layered cover plate 12. As such, the pressure sensors 44 only detect if additional weight is present upon the layered cover plate 12. More specifically, the pressure sensors 44 are calibrated to detect if a minimum threshold weight is flexing the cover plate directly above one of the long beam supports 40 or one of the short beam supports 42. Since the long beam supports 40 coincide in position with the imaged white keys 30 and the short beam supports 42 coincide in position with the imaged black keys 32, it will be understood that the pressure sensors 44 can detect if a person is standing upon an imaged white key 30 or an imaged black key 32.

The pressure sensors 44 are attached to the tops of the various beam supports 40, 42. Preferably more than one pressure sensor 44 is used in series upon each of the beam supports 40, 42. In this manner, should any one sensor 44 on any one support beam 40, 42 fail, the floor instrument 10 will still operate using the pressure sensors 44 that are present and still function. The redundancy of the pressure sensors 44 ensure that the overall floor instrument 10 will have a long and robust life.

The long beam supports 40 and the short beam supports 42 rest upon the bottom surface 20 of the housing 16. The long beam supports 40 and the short beam supports 42 have side edges 48. Lights 50 are mounted to the side edges 48. When the lights on the side edges 48 of a long beam support 40 or a short beam support 42 are illuminated, they shine light through the cover plate 12. In the cover plate 12, the decorative layer 24 is translucent. The protective layer 26 is clear. As such, the lights 50 can be observed from above the cover plate 12. Since the lights 50 are attached to the side edges 48 of a long beam support 40 or a short beam support 42, the lights 50 will appear to illuminate either the imaged white keys 30 or the imaged black keys 32 above the lights 50. Consequently, different imaged white keys 30 and imaged black keys 32 can be illuminated by lighting the lights 50 on the beam supports 40, 42 under those imaged keys.

Figure 5:
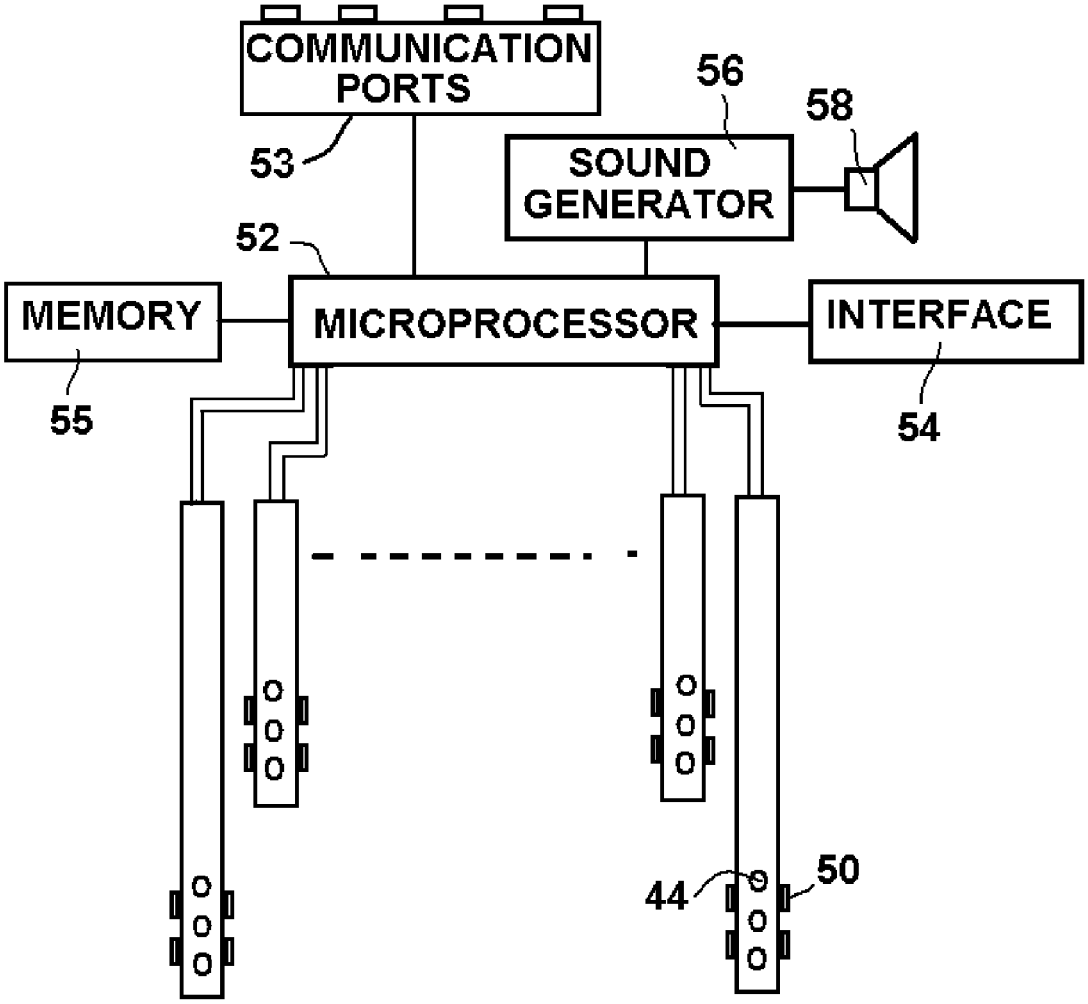
FIG. 5 is a schematic showing the electronic components of the exemplary embodiment.

Referring to FIG. 5 in conjunction with FIG. 3, it can be seen that the various lights 50 and pressure sensors 44 are coupled to a microprocessor 52. The microprocessor 52 is held within the electronic support area 38 within the housing 16. Signals received from the pressure sensors 44 inform the microprocessor 52 as to the foot position of any person standing upon the active keyboard section 14 of the cover plate 12.

The microprocessor 52 is coupled to an interface 54. If the floor instrument 10 is inset into a floor, the interface 54 can be a handheld unit that communicates with the microprocessor 52 wirelessly. This avoids the use of switches and button that can be damaged if stepped upon. Alternatively, a small door can be formed in the cover plate 12. The interface 54 can be positioned under the door so that it is protected.

The microprocessor 52 is coupled to a digital memory 55. The digital memory 55 contains the music for a wide variety of songs that can be selected using the interface 54. The microprocessor 52 is also attached to an electronic sound generator 56 that is capable of generating the sound signals that correspond to the keys 30, 32 on the keyboard image 28. The microprocessor 52 is also attached to one or more communications ports 53. The communication ports 53 connect the microprocessor 52 with external devices, such as speakers, computers, tablets, smart phones and the like. The communications ports 53 also enable the microprocessor to have a USB or similar port access that can be used for Bluetooth and WiFi communications. Lastly, speakers 58 are provided to broadcast the sound signals.

The floor instrument 10 can be operated in at least two modes. The two modes include a free mode and a teaching mode. In the free mode, the floor instrument 10 will light the key 30, 32 and play the note for whatever imaged white key 30 or imaged black key 32 is stepped upon. In this mode, a person can play any piece of music he/she desires and is physically able to accomplish.

Figure 6:
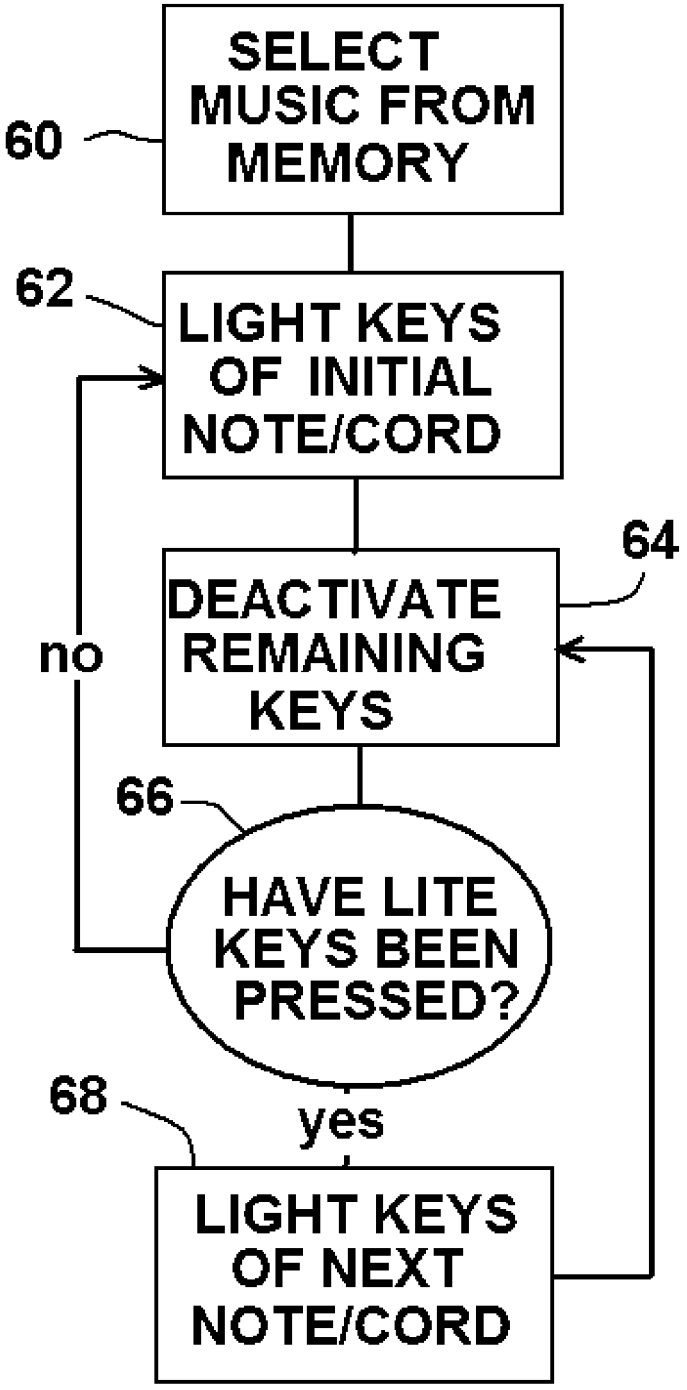
FIG. 6 is a block logic diagram showing an exemplary method of operation.

Referring now to FIG. 6 in conjunction with FIG. 3 and FIG. 5, the teaching mode can be explained. In the teaching mode, a person selects a piece of music from the memory. See Block 60. The microprocessor 52 lights the key/keys 30, 32 that correspond to the first note/cord for the selected music and deactivates all the other keys. See Block 62 and Block 64. The user must then step on the appropriate imaged white keys 30 and/or imaged black keys 32 that are illuminated. See Block 66. The microprocessor 52 will light a subsequent note/cord only after the person successfully steps upon the initial note/cord. See Block 68. Since all other keys are deactivated, the microprocessor 52 will not light or sound any imaged key 30, 32 that is inadvertently stepped upon. This enables a person to walk across the floor instrument 10 to a selected key without sounding the intervening keys. For example, suppose the floor instrument 10 lights an imaged white key 30 at one end of the cover plate 12. After that key 30 is stepped upon, the microprocessor 52 may light an imaged black key 32 near the opposite end of the cover plate 12. A person can walk across the cover plate 12 to that next key 32 without activating any of the other keys. The microprocessor 52 deactivates all the keys that are not currently being illuminated. In this manner, a person does not have to jump from key to key or step off the floor instrument 10 between key strikes. The result is a floor instrument 10 that can be played at the pace of the user and can accommodate decreased physical and/or mental abilities, while providing a rewarding experience. The floor instrument 10 can therefore be played by the elderly and infirm as well as the young and agile.

The microprocessor 52 can control the intensity and color of the lights at the various keys. This enables the floor instrument 10 to operate in advanced teaching modes. For example, the floor instrument 10 may brightly illuminate the next key to be played, while dimly illuminating the key to be played after that. The dimly lit keys provide an anticipatory cue as to what notes will need to be subsequently played.

It will be understood that the embodiment of the present invention that is illustrated and described is merely exemplary and that a person skilled in the art can make many variations to that embodiment. All such embodiments are intended to be included within the scope of the present invention as defined by the claims.

What is claimed is:

1. An electronic instrument, comprising:

a translucent plate containing an image of a keyboard with imaged white keys and imaged black keys, wherein said translucent plate has a thickness of at least ⅛ inch;

a clear protective plate disposed directly atop said translucent plate, wherein said clear protective plate has a thickness of at least ¼ inch and covers all of said image, wherein said translucent plate and said clear protective plate combine to form a layered cover;

a plurality of support beams arranged in parallel and supporting said layered cover in a horizontal plane, wherein at least one of said plurality of support beams is disposed under each of said imaged white keys and each of said imaged black keys;

a plurality of pressure sensors, wherein at least one of said plurality of pressure sensors is affixed to each of said plurality of support beams, and wherein said plurality of pressure sensors are interposed between said plurality of support beams and said layered cover;

an electronic sound generator that is triggered by said plurality of pressure sensors, said electronic sound generator being capable of generating a different note for each of said imaged white keys and each of said imaged black keys.

2. The instrument according to claim 1, wherein said imaged white keys are longer than said imaged black keys, and wherein said plurality of support beams include long support beams that are disposed under said imaged white keys and short support beams that are positioned under said imaged black keys.

3. The instrument according to claim 2, wherein only one of said plurality of support beams is disposed under each of said imaged white keys and each of said imaged black keys.

4. The instrument according to claim 1, further including lights coupled to each of said plurality of support beams.

5. The instrument according to claim 4, further including a microprocessor that receives signals from said plurality of pressure sensors and controls said lights.

6. An electronic instrument, comprising:

a housing divided between a first section and a second section by a hinged connection that enables said housing to be selectively configured in an open configuration and a folded configuration; wherein both said first section and said second section having a bottom surface and an open top;

a plurality of metal support beams disposed in said housing on said bottom surface of both said first section and said second section;

a flexible cover plate containing an image of keyboard keys thereon, said cover plate containing a first top layer of plastic and a second bottom layer of plastic that abut against each other, wherein said second bottom layer of plastic is translucent and said keyboard keys are imaged on said second bottom layer of plastic, and wherein said cover plate is divided into two parts and covers said open top of both said first section and said second section of said housing and wherein each of said keyboard keys aligns over one of said metal support beams;

pressure sensors affixed to each of said metal support beams wherein said pressure sensors detect flex in said keyboard keys of said cover plate aligned there above; and an electronic sound generator that is triggered by said pressure sensors, said electronic sound generator being capable of generating a different note for each of said keyboard keys.

7. The instrument according to claim 6, wherein each of said metal support beams has a flat top surface that faces said cover plate.

8. The instrument according to claim 6, wherein said metal support beams include a plurality of long support beams and a plurality of short support beams that are interposed in parallel along said bottom surface of said housing.

9. The instrument according to claim 6, wherein said cover plate has a thickness of at least ½ inch.

10. The instrument according to claim 6, further including lights coupled to each of said plurality of metal support beams.

11. The instrument according to claim 10, further including a microprocessor that receives signals from said pressure sensors and controls said lights.

12. An electronic keyboard assembly played by the feet of a walking person, said assembly comprising:

a flexible cover plate having a decorative layer that bears a plurality of imaged keyboard keys and a protective layer that covers said decorative layer, wherein said decorative layer is translucent and said protective layer is clear;

beam supports supporting said flexible cover plate, wherein a separate metal beam is disposed under each of said imaged keyboard keys;

sensors for sensing when said flexible cover plate is stepped upon over any of said keyboard keys;

a sound generator that is triggered by said sensors, said sound generator being capable of generating a different note for each of said keyboard keys.

13. The instrument according to claim 12, further including lights coupled to each of said support beams for illuminating said imaged keyboard keys.

14. The instrument according to claim 13, further including a microprocessor that receives signals from said sensors and controls said lights.

* * * * *